United States Patent [19]

Storck

[11] 4,082,411

[45] Apr. 4, 1978

[54] ELECTRICAL CONNECTORS AND CONTACT ASSEMBLIES THEREOF

[75] Inventor: Glenn E. Storck, Long Valley, N.J.

[73] Assignee: Amerace Corporation, New York, N.Y.

[21] Appl. No.: 683,842

[22] Filed: May 6, 1976

[51] Int. Cl.[2] ..... H01R 13/06

[52] U.S. Cl. ..... 339/252 R; 339/256 R

[58] Field of Search ..... 339/252, 255, 256, 95

[56] References Cited

U.S. PATENT DOCUMENTS

| | | | |
|---|---|---|---|
| 3,831,129 | 8/1974 | Frey | 339/252 R |

FOREIGN PATENT DOCUMENTS

| | | | |
|---|---|---|---|
| 1,058,049 | 11/1953 | France | 339/252 P |
| 2,035,681 | 1/1972 | Germany | 339/256 RT |
| 340,878 | 10/1959 | Switzerland | 339/252 P |

*Primary Examiner*—Joseph H. McGlynn

*Attorney, Agent, or Firm*—S. Michael Bender

[57] ABSTRACT

An electrical connector includes a terminal member and a contact element, the terminal member having separable parts each providing a surface for retaining the contact element, the terminal member providing for predetermined minimum spacing between such retention surfaces. In its preferred embodiments, the connectors are of plug and socket terminal member variety with either the plug or socket having such separable parts with the parts defining respective abutting surfaces providing such predetermined spacing.

13 Claims, 7 Drawing Figures

ELECTRICAL CONNECTORS AND CONTACT ASSEMBLIES THEREOF

FIELD OF THE INVENTION

This invention relates generally to electrical connectors and contact assemblies thereof and more particularly to electrical contact assemblies having so-called louvered contact elements.

BACKGROUND OF THE INVENTION

Louvered contact elements comprise elongate electrically conductive strip members having transverse expanses which are bent or twisted with respect to the strip member so as to provide opposed sets of contact fingers extending outwardly of the strip member. In providing a connector, such contact element is assembled with one set of its contact fingers in engagement with one terminal member and this assembly mates with another terminal member which is engaged by the other contact finger set. Known connectors employ louvered contact elements in flat configuration in conjunction with flat terminal members and in cylindrical configuration in which case the terminal members are of plug and socket configuration, as shown, for example, in Crabbs U.S. Pat. No. 2,217,473 and Neidecker U.S. Pat. No. 3,453,587.

Connectors of louvered contact element type have the capability of maximizing current flow for a given voltage drop between a pair of terminal members by virtue of their increased surface contact area over that attainable by direct mutual engagement of such terminal members. The realization of maximized current flow is dependent, in one aspect, on providing secure retention of the louvered contact element in or on its associated supporting terminal member while at the same time maintaining the intended surface engagement therebetween as called for by design specifications.

Various contact retention measures are presently known. In the above-referenced Crabbs patent, a plug and socket connector arrangement (FIG. 7) embodies a louvered contact element which is retained through a self-biasing arrangement, i.e., the louvered contact element strip member is formed into a cylinder and is nested by its own resilience in an axially extending cylindrical recess formed in the socket with the outwardly extending set of the contact element fingers engaging the recess wall. The plug is engaged by the interiorly extending finger set on insertion in the socket. A like self-biasing arrangement is shown in the above-referenced Neidecker patent. This latter patent also provides for assembly of the contact element in encircling relation to the plug (FIGS. 8 and 9) wherein the strip member is provided with crenellated edges which are bent over axially spaced shoulders of the plug, the plug surface between the shoulders being engaged by the interiorly extending finger set. A variation of this last-discussed technique is shown in Niederer U.S. Pat. No. 3,751,619.

The employment of self-bias for contact element retention in socket terminal members becomes less reliable as socket diameters increase and self-biasing retention forces decrease, thereby increasing the likelihood of unintended contact element removal upon plug manipulation.

Commonly-assigned copending application Ser. No. 503,783 of Johnson et al., filed on Sept. 6, 1974 discloses, in one of its aspects, that louvered contact element self-biased retention in socket terminal members is enhanced by providing respectively dissimilar longitudinal extents for the contact element finger sets. With the shorter length finger set extending to the socket recess wall, the contact element is seated more deeply in the socket and is accordingly better retained by self-bias. Such arrangement also provides lessened spring rate for the longer contact finger set engaging the plug thereby reducing manufacturing tolerances for the connector parts.

In addition to the foregoing arrangements wherein louvered contact elements are retained by self-bias in sockets or by having parts thereof interfittable with plugs, the art has looked to embodiments wherein the contact elements may be positively retained either on the plug or socket terminal members by means apart from the contact elements. Thus, in a present commercial practice, cylindrically formed contact elements are seated on plugs and retention rings are snapped onto the sides of the strip member to force the same onto the plug surface. Further, in literature distributed by Multilam Corporation, Los Altos, California and dated July 12, 1973, arrangements are depicted (pages 9 and 10) wherein a pair of cylinders, apparently dimensioned either to snugly encircle a plug or to snugly nest in a socket are arranged to abut a cylindrically formed louvered contact element therebetween. The cylinders each apparently present a surface to the contact element which is inclined with respect thereto to retain the same in place.

The positive contact element retention inherent in such commercial and literature arrangements is believed to suffer certain disadvantages. For example, contact element replacement is more difficult than in the self-biased and crenellated edge embodiments noted heretofore. In the commercial arrangement, snap rings need be removed. In the literature arrangement, an apparent wedge-fitted cylinder need be removed. Further, in the case of each of these arrangements, it is considered difficult to achieve the aforesaid intended design specification surface engagement between the louvered contact element and its supporting terminal member due to inherent variations in retention forces imposed by the retention elements themselves and/or by the person assembling or reassembling the connector. As will be appreciated, variations in retention forces which displace the web sides of the strip member can adversely affect intended contact finger surface engagement.

Further patents which serve as background material for the subject invention in describing connectors subject to the foregoing operational shortcomings include Deal U.S. Pat. Nos. 3,861,595 and 3,861,776, Burke U.S. Pat. No. 1,901,894, Streib U.S. Pat. No. 2,280,728 and German Pat. No. 1,106,390.

SUMMARY OF THE INVENTION

It is an object of the present invention to provide improved electrical connectors and louvered contact assemblies therefor.

It s a more specific object of the invention to provide for enhanced retention of louvered contact elements in a terminal member while insuring against any departure from intended contact surface engagement therein.

It is a further object of this invention to provide for convenient and improved assembly of electrical connectors having louvered contact elements.

In attaining the foregoing and other objects and features, the invention provides an electrical connector having a contact assembly including a louvered contact element supported by a terminal member in first part defining support and retention surfaces for the contact element and in second part, separable from such first part and of complementary configuration therewith, the second part defining at least a further retention surface for the contact element, such first and second parts providing for predetermined spacing of the contact element retention surfaces thereof. Such terminal member is preferably elongate and its respective parts abut along surfaces transverse to the member longitudinal axis to provide said retention surface spacing, and the parts thereof are preferably threadably engageable along such axis. The terminal member having such separable parts may comprise either the plug or socket in a cylindrically configured connector.

In assembling contact assemblies of the invention, the contact element strip member is formed into a cylinder and is arranged in coaxial disposition within or about the terminal member first part support surface and in engagement with the contact element retention surface thereof. The terminal member second part is then secured to the first part and in the course of such securement has its contact element retention surface moved into engagement with the contact element at such predetermined spacing from the first part contact retention surface. Tools are provided to facilitate this assembly as discussed hereinafter, whereby the contact element is subjected to no greater compressive force during assembly than is applied thereto in its subsequent circuit interconnecting use.

The foregoing and other objects and features of the invention will be evident from the following detailed description of preferred embodiments and practices and from the drawings wherein like reference numerals identify like parts throughout.

DESCRIPTION OF THE PREFERRED EMBODIMENTS

Figure 1:
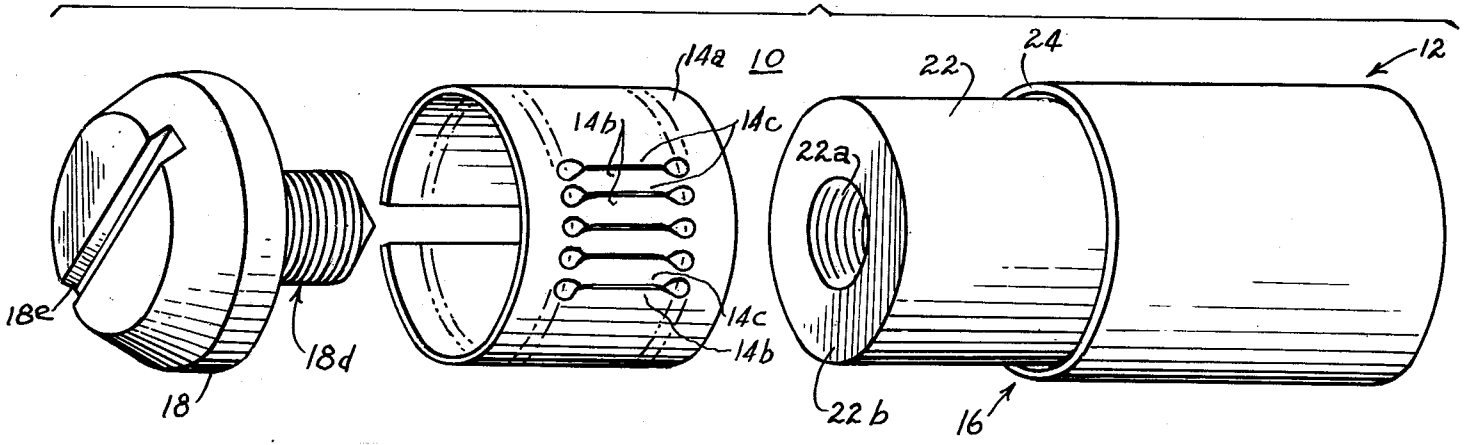
FIG. 1 is an exploded view of a contact assembly according with the invention in a plug terminal member embodiment.
Figure 2:
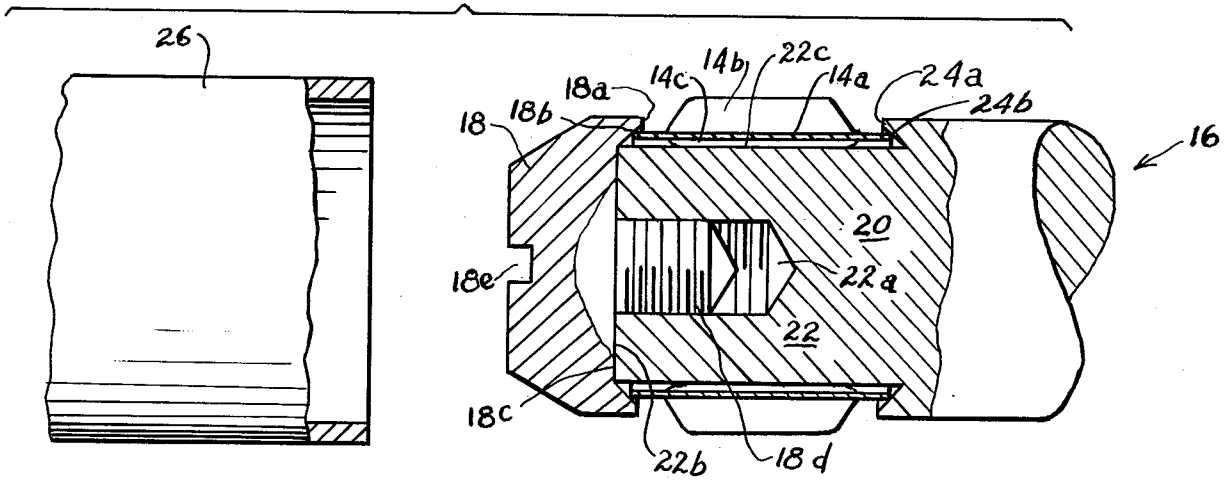
FIG. 2 is a sectional elevation of the contact assembly of FIG. 1 as assembled and shown with a matable terminal member disconnected therefrom.

Referring to FIGS. 1 and 2, plug contact assembly 10 includes a male terminal member or plug 12 and a contact element or band 14 of above-mentioned louvered type, having a strip member or web 14*a* with contact finger sets 14*b* and 14*c* extending outwardly from opposite surfaces thereof. The strip member is formed into a cylinder with its ends 14*d* and 14*e* slightly spaced apart. Plug 12 has separable first and second parts 16 and 18, referred to for convenience as body part 16 and nose part 18. Body part 16 has a rightward portion 20 of diameter exceeding that of leftward portion 22, a contact element retention surface 24 extending between the surfaces of portions 20 and 22. As is better seen in FIG. 2, such surface 24 preferably includes one surface expanse 24*a* extending generally transversely of portion 22 and another surface expanse 24*b* preferably extending at an acute angle to portion 22. Nose 18, as also better seen in FIG. 2, includes counterpart surface expanses 18*a* and 18*b*, the latter terminating in a generally transverse central surface 18*c*. An exteriorly threaded body 18*d* projects from central surface 18*c* for engagement with the interiorly threaded wall of recess 22*a*, extending inwardly of generally transverse surface 22*b* of portion 22. At its end surface opposite surface 18*c*, nose 18 includes a slot 18*e*.

In assembling the parts of FIG. 1, contact element 14 may be gripped between the thumb and forefinger and slipped onto portion 22 and is forcibly pressed radially onto contact support surface 22*c* of portion 22 until the rightward web side thereof is tucked under surface expanse 24*a* so as to engage surface expanse 24*b*. With this partial assembly maintained in position, nose 18 is joined to portion 22 by being threadably run up thereon until surfaces 18*c* and 22*b* abut each other, on which occurrence the leftward web side of contact element 14 is tucked under surface expanse 18*a* and in engagement with surface expanse 18*b*. The contact assembly may now be engaged for electrical circuit interconnection by a mating terminal member, such as socket terminal 26 of FIG. 2.

The opposed finger sets, 14*b* and 14*c*, of contact element 14 are preferably of dissimilar longitudinal extent, as in the above-mentioned copending Johnson et al. patent application. As is seen in FIG. 2, with set 14*b* of greater length than set 14*c*, web 14*a* may accordingly be retained more deeply in engagement with portion 22 than in the case of the customary symmetrical louvered contact. As will also be observed in the FIG. 2 showing, contact finger set 14*c* tightly engages the surface of electrically conductive portion 22 with web 14*a* being thrust radially outwardly against retention surface expanses 18*b* and 24*b* but, however, being free from the deforming forces which would be imposed thereon by a compressive snap-ring or like member engaging its radially outward surface. Further, by virtue of its inclusion of means providing for a predetermined minimum spacing between surface expanses 18*b* and 24*b*, i.e., the spacing therebetween shown in FIG. 2, such contact assembly of the invention precludes deformation of web 14*a* which might be occasioned by lesser separation of such retention surfaces as may occur in the absence of such spacing means. The preferred spacing means for this purpose, as shown in FIGS. 1 and 2, are the respective axially abutting surfaces 18*c* and 22*b*.

Figure 3:
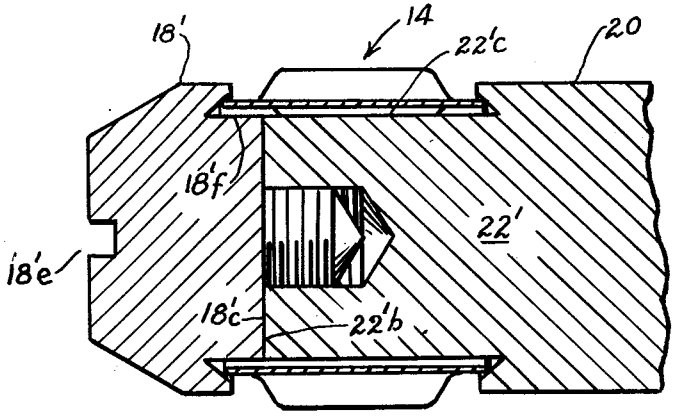
FIG. 3 is a sectional elevation depicting a modified form of the contact assembly of FIGS. 1 and 2.

A modified form of the contact assembly of FIGS. 1 and 2 is shown in FIG. 3 wherein nose 18' has its central surface 18'*c* displaced from the inward extremeties of surface expanse 18'*b* and defines a contact element support surface 18*f*. In this embodiment, body portion 22' has its end surface 22'*b* in closer proximity to the inner extremity of surface 24*b* to provide contact element support surface 22'*c*. One web side of contact element 14 overlaps nose 18' as contrasted with the configuration of FIGS. 1 and 2 wherein both web sides of contact element 14 overlie portion 22.

Figure 4:
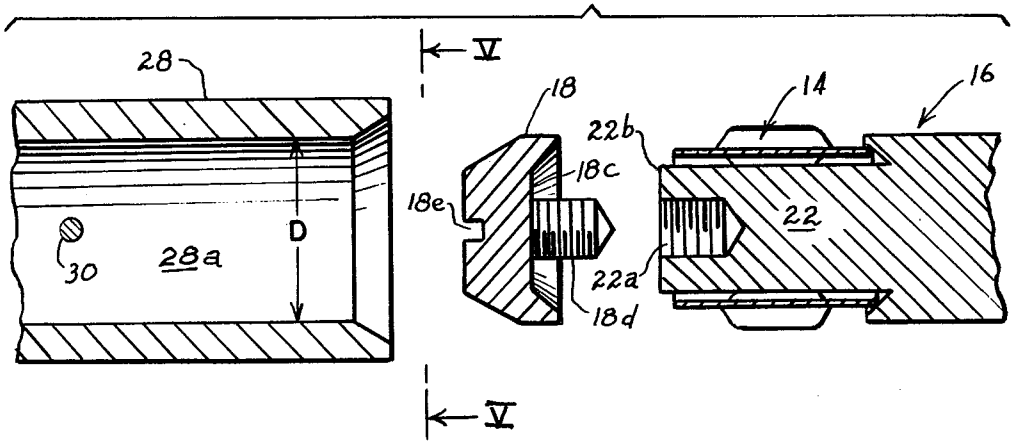
FIG. 4 is a sectional elevation of the contact assembly of FIG. 2 with parts thereof separated and further showing a tool for assembling the parts.
Figure 5:
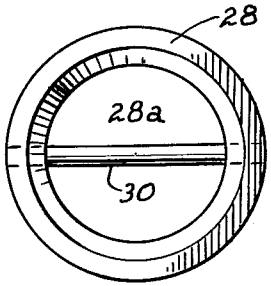
FIG. 5 is a showing of the FIG. 4 tool as seen from the plane V—V of FIG. 4.

FIG. 4 illustrates a kit of parts for use in assembling the contact assemblies illustrated in FIGS. 1–3 and provides a tool 28 which has particular benefit in limiting the radially compressive force applied manually to strip member 14*a* in the assembly practice discussed above. Such tool 28 is a hollow cylinder having the inner diameter D of its axially extending passage 28*a* equal to the inner diameter of mating terminal 26 of FIG. 2. Tool 28 supports a transverse rod or engaging bar 30 adapted to engage slot 18*e* (FIG. 1) of nose 18. In use of the kit and tool of FIG. 4, either for original assembly of parts or reassembly upon replacing the contact element, the contact element is cylindrically formed and applied to portion 22 to an axial depth less than surface expanse 24*b*. The contact element is preferably cylindrically formed in the course of its manufacture after which it is suitably heat treated to retain such configuration. With the contact element encircling portion 22, nose 18 is inserted in the axial passage of tool 28 such that slot 18*e* engages bar 30. The tool is now forced over contact element 14 onto portion 22, advancing web 14*a* into engagement with surface expanse 24*b*, and is rotatably run up on portion 22 to thread projection 18*d* into recess 22*a*. Abutment of surfaces 18*c* and 22*b* (FIGS. 1 and 2) will complete the assembly as in the above-described assembly practice not using tool 28. On that event, the assembly is formed as shown in FIG. 2 and tool 28 is slipped therefrom.

As will now be appreciated, the assembly practice using tool 28 arranges contact element 14 interiorly of the retention surface expanses while imposing no greater radial compressive force on the contact element than will be imposed thereon in its circuit interconnection use. Further, tool 28 applies such compressive force uniformly circumferentially to the contact element, thereby insuring that the entirety of the web sides are tucked into engagement with the retention surface. This is to be contrasted with the first-mentioned assembly practice wherein spaced circumferential forces are applied to the contact element, for example, by the thumb and forefinger, whereby an assembler may be required to circumferentially fit the assembly into such tucked arrangement.

Figure 6:
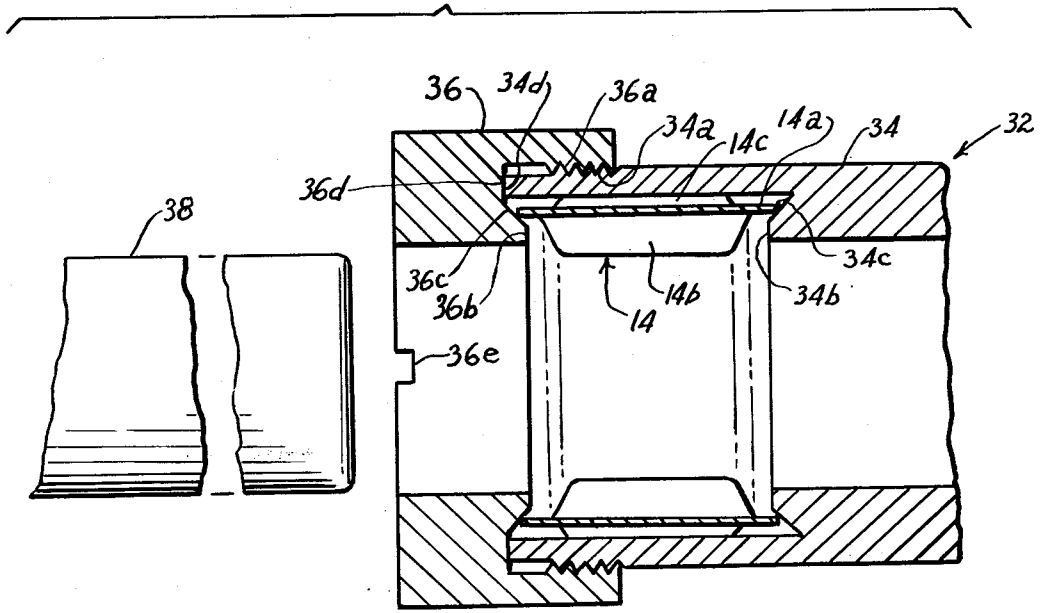
FIG. 6 is a sectional elevation of a further embodiment of contact assembly in accordance with the invention wherein the terminal member having separable parts is in socket configuration.

Referring now to FIG. 6, socket terminal member 32 has relesably engaged hollow cylindrical parts 34 and 36, part 34 being exteriorly threaded at surface 34*a* and part 36 being interiorly threaded at surface 36*a*. Part 34 has an axially extending recess engaged by finger set 14*c* and defines a surface having expanse 34*b* extending generally transversely radially of part 34 and expanse 34*c* engaged by the rightward side of contact element web 14*a*. Finger set 14*b* extends into an axial passage in part 34, part 34 defining a leftward end surface 34*d* beyond the leftward side of web 14*a*.

Socket terminal member part 36 further has a surface expanse 36*b* extending generally transversely or radially of part 36 and a surface expanse 36*c* engaged by the leftward side of contact element web 14*a*. Part 36 may have opposed slots 36*e* formed peripherally at its leftward end. As in the plug contact assembly above discussed, surfaces 34*d* and 36*d* of the respective parts 34 and 36 are in abutting relation to define a predetermined minimum axial spacing between retention surface expanses 34*c* and 36*c*.

Figure 7:
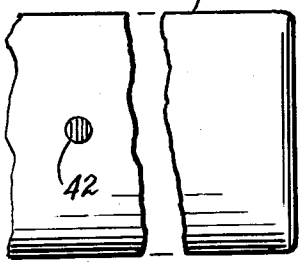
FIG. 7 is a side view of a tool for use in assembly of the FIG. 6 contact assembly.

In assembling the FIG. 7 contact arrangement, with parts 34 and 36 separated, contact element 14 is formed into a cylinder and radially compressed to a degree permitting insertion thereof interiorly of part 34 until the rightward side of web 14*a* is in tucked engaging relation to surface expanse 34*c*. Part 36 is now threadably run upon part 34 and, as surfaces 34*d* and 36*d* abut one another, the leftward side of web 14*a* is disposed in like tucked engagement with surface expanse 36*c*. Plug terminal member 38 may now be inserted interiorly of parts 36 and 34 to engage contact finger set 14*b* and provide the desired circuit connection.

FIG. 7 depicts assembly tool 40 which may be employed in conjunction with the FIG. 6 contact assembly, particularly in instances wherein the contact element may not seat by self-bias in tucked relation to surface expanse 34*c*. Tool 40 is of outer diameter equal to the outer diameter of plug terminal member 38. Contact element 14 (FIG. 6) is formed into a cylinder and inserted in terminal member part 34 to an axial depth less than surface expanse 34*b*. Terminal member part 36 is now applied to tool 40 with engaging bar 42 seated in slots 36*e* and the tool is inserted into the contact element in engagement with finger set 14*b*. Finger set 14*b* is thereby loaded, as in circuit interconnection use and web 14*a* is forced into its design-intended radial position, interiorly of surface expanse 34*b*. Continued movement of the tool into part 34 places the rightward contact element web side in engagement with surface expanse 34*c*. The tool is now rotated, bringing surfaces 36*d* and 34*d* into abutting relation and disposing the leftward web side in tucked relation to surface expanses 36*b* and 36*c*. The tool is now withdrawn, leaving the contact assembly in its FIG. 6 configuration.

In the foregoing arrangements discussed above, the separable terminal member need be comprised in its part adapted for connection to external circuitry, e.g., part 16 of FIGS. 1–3 and part 34 of FIG. 6, of electrically conductive material, such as copper, brass or aluminum, with the remaining part of either conductive material or electrically insulative material, such as delrin, nylon, or the like. Contact element 14 is of electrically conductive material and may be comprised, for example, of a beryllium copper alloy. Assembly tools 28 and 40 may be comprised of aluminum, teflon, nylon or like suitably rigid material. Other material choices and variations in the foregoing embodiments evident to those skilled in the art may be introduced without departing from the subject invention. Accordingly, the particularly disclosed preferred embodiments are intended in an illustrative and not in a limiting sense. The true spirit and scope of the invention is set forth in the appended claims.

I claim:

1. An electrical contact assembly having a terminal member defining a contact element support surface and a contact element engagingly supported thereby, said contact element comprising a strip member having opposed surfaces extending between margins of said strip member and first and second contact fingers extending respectively angularly outwardly of said opposed surfaces of said strip member, said first contact fingers engaging said contact element support surface, said terminal member having first and second releasably engaged parts defining first and second retention surfaces respectively engaging said strip member margins and means for providing predetermined spacing between said first and second retention surfaces whereby such engagement of said first contact fingers and said contact element support surface is maintained by said first and second retention surfaces, with said strip member being maintained substantially equidistant from said support surface throughout the extent of said strip member between said margins thereof.

2. The contact assembly claimed in claim 1 wherein such spacing means is constituted by respective integral portions of said first and second terminal member parts.

3. The contact assembly claimed in claim 2 wherein said respective integral portions of said first and second terminal member parts are in mutually abutting relation.

4. The contact assembly claimed in claim 1 wherein said terminal member is elongate and wherein said first and second parts thereof are releasably engaged along the terminal member longitudinal axis, such spacing means comprising respective portions of said first and second terminal member parts in abutting relation.

5. The contact assembly claimed in claim 4 wherein said respective portions of said terminal member first and second parts comprise ends thereof defining abutting end surfaces extending transversely to said terminal member longitudinal axis.

6. The contact assembly claimed in claim 5 wherein said, terminal member first part defines a contact support surface extending from said retention surface thereof to said end surface thereof.

7. The contact assembly claimed in claim 6 wherein said retention surfaces each include a surface expanse disposed at an acute angle to said terminal member longitudinal axis.

8. The contact assembly claimed in claim 4 wherein said terminal member first and second parts are respectively complementarily configured to provide such releasable engagement thereof.

9. The contact assembly claimed in claim 8 wherein said terminal member second part includes an exteriorly threaded projection and wherein said terminal member first part includes an interiorly threaded recess for receiving said projection.

10. The contact assembly claimed in claim 1 wherein the longitudinal extent of said first contact fingers angularly outwardly with respect to a corresponding surface of said strip member is less than the longitudinal extent of said second contact fingers angularly outwardly with respect to a corresponding opposed surface of said strip member.

11. The contact assembly claimed in claim 10 wherein said terminal member first part is of elongate cylindrical configuration, said strip member encircling and said first contact fingers engaging said terminal member first part, such spacing means comprising respective portions of said terminal member first and second parts in abutting relation.

12. The contact assembly claimed in claim 1 and a further terminal member engaging said contact element.

13. The invention claimed in clam 12 wherein said terminal member first part is encirclingly engaged by said contact element and said further terminal member is disposed in encircling engaging relation to said contact element.

* * * * *

UNITED STATES PATENT AND TRADEMARK OFFICE

CERTIFICATE OF CORRECTION

PATENT NO. : 4,082,411

DATED : April 4, 1978

INVENTOR(S) : Glenn E. Storck

It is certified that error appears in the above-identified patent and that said Letters Patent are hereby corrected as shown below:

Column 1, line 27, change "2,217,473" to --2,217,433--.

Signed and Sealed this

*Fifteenth* Day of *July 1980*

[SEAL]

*Attest:*

SIDNEY A. DIAMOND

*Attesting Officer*

*Commissioner of Patents and Trademarks*